US011793259B1

(12) United States Patent
Jenkins

(10) Patent No.: US 11,793,259 B1
(45) Date of Patent: Oct. 24, 2023

(54) HEAD COVERING

(71) Applicant: Ashley Jenkins, Uxbridge (CA)

(72) Inventor: Ashley Jenkins, Uxbridge (CA)

( * ) Notice: Subject to any disclaimer, the term of this patent is extended or adjusted under 35 U.S.C. 154(b) by 0 days.

(21) Appl. No.: 17/940,409

(22) Filed: Sep. 8, 2022

(51) Int. Cl.
*A42B 1/12* (2006.01)

(52) U.S. Cl.
CPC ..... *A42B 1/12* (2013.01)

(58) Field of Classification Search
CPC ..... A42B 1/12; A42B 1/004; A42B 1/049; A62B 33/00; A45D 8/40
See application file for complete search history.

(56) References Cited

U.S. PATENT DOCUMENTS 946,770 A * 1/1910 Sands ..... A42B 1/12 2/209.12
1,133,196 A * 3/1915 Teugler ..... A41G 3/00 132/54
1,363,408 A * 12/1920 Guinzburg ..... A42B 1/12 2/68
1,436,235 A * 11/1922 Bush ..... A42B 1/12 2/68
1,488,515 A * 4/1924 Rand ..... A41B 13/04 2/400
2,063,232 A * 12/1936 Davies ..... A42B 1/12 450/112
2,242,420 A * 5/1941 Di Giovanna ..... A42B 1/12 132/53
2,269,868 A * 1/1942 Smith ..... A42B 1/12 2/68
2,286,652 A * 6/1942 Sheffield ..... A42B 1/12 2/68
2,533,879 A * 12/1950 Di Giovanna ..... A42B 1/12 2/68
2,574,558 A * 11/1951 Graber ..... A41G 5/0093 132/53
2,651,310 A * 9/1953 Selson ..... A41G 5/0093 132/274
2,889,557 A * 6/1959 Blair ..... A41G 5/0093 132/54
2,897,511 A * 8/1959 Blair ..... A42B 1/004 2/244

(Continued)

FOREIGN PATENT DOCUMENTS

CA 2935974 A1 * 1/2018 ..... A41D 20/00
GB 2395419 A * 5/2004 ..... A41G 3/00

*Primary Examiner* — Alissa L Hoey
(74) *Attorney, Agent, or Firm* — Orin Del Vecchio

(57) ABSTRACT

A head covering that is operable to be secured to a user's head and provide coverage thereof so as to inhibit hair on the user's head from being contacting by water. The present invention includes a first portion and a second portion wherein the second portion is releasably secured to the first portion. The first portion is dome shaped having a cavity to receive a user's head. The first portion includes a first seam located at the lower peripheral edge of the first portion. A second seam is provided adjacent to the first seam and together function to inhibit water from egressing therepast. A band member having fasteners are secured to the outer surface of the first portion. A second portion having a band member and fasteners are provide to secure to the first portion wherein the second portion is either a wig, a head-wear or a combination thereof.

6 Claims, 3 Drawing Sheets

(56) References Cited

U.S. PATENT DOCUMENTS 2,929,071 A * 3/1960 Sterling ..... A42B 1/12 2/68
3,052,888 A * 9/1962 Blanchard ..... A42B 1/12 2/68
3,131,400 A * 5/1964 Blanchard ..... A42B 1/12 D2/894
3,163,866 A * 1/1965 Denmark ..... A42B 1/12 428/26
3,234,563 A * 2/1966 Tabbat ..... A42B 1/12 2/171.03
3,247,521 A * 4/1966 Owen ..... A42B 1/12 D2/867
3,255,460 A * 6/1966 Pastore ..... A42B 1/12 D2/891
3,295,536 A * 1/1967 Shaw ..... A41G 5/0093 2/200.1
3,385,305 A * 5/1968 Buzzelli ..... A41G 3/00 D28/92
3,460,546 A * 8/1969 Abbott ..... A41G 5/0093 132/53
3,495,603 A * 2/1970 Young, Jr. ..... A41G 3/00 24/442
3,505,149 A * 4/1970 Sanchez ..... A42B 1/12 156/251
3,750,681 A * 8/1973 Claunch ..... A45D 8/40 2/172
3,782,396 A * 1/1974 Tomlinson ..... A41G 5/0093 D28/92
3,889,414 A * 6/1975 Whetzel ..... A63H 3/44 446/394
3,910,292 A * 10/1975 Izzo ..... A41G 5/0093 2/200.1
3,996,621 A * 12/1976 Martienssen ..... A42B 1/12 2/68
4,599,749 A * 7/1986 Childs ..... A42B 1/041 132/53
4,804,003 A * 2/1989 Moen ..... A41G 5/0093 132/274
5,239,705 A * 8/1993 Leopold ..... A41G 5/0093 132/273
5,493,735 A * 2/1996 Rice ..... A42B 1/004 2/209.13
5,647,384 A * 7/1997 Haber ..... A41G 5/00 132/54
5,806,535 A * 9/1998 Becker ..... A41G 5/0093 132/54
5,819,319 A * 10/1998 Spurs ..... A42B 1/24 2/172
6,189,152 B1 * 2/2001 Lofton ..... A42B 1/041 2/174
7,047,571 B1 * 5/2006 Kelly ..... A42B 1/004 2/209.13
7,836,523 B2 * 11/2010 Castle ..... A41G 5/0093 2/202
8,584,682 B1 * 11/2013 Naylor ..... A41G 5/0093 2/209.13
8,991,406 B1 * 3/2015 Salter ..... A41G 3/0016 132/274
9,089,178 B1 * 7/2015 Clarke ..... A41G 3/0058
9,179,721 B2 * 11/2015 Hines ..... A41G 3/0033
9,398,780 B1 * 7/2016 Matallana ..... A42B 1/12
9,555,288 B1 * 1/2017 Lucas ..... A63B 33/00
D788,411 S * 6/2017 Daramola ..... D2/867
D814,149 S * 4/2018 Preston ..... D2/866
10,021,929 B1 * 7/2018 Kirschner ..... A41G 5/0093
10,039,334 B2 * 8/2018 Thompson-Buist ... A42B 1/049
10,051,907 B2 * 8/2018 Dammann ..... A42B 1/12
10,368,600 B2 * 8/2019 Goldner ..... A41G 5/0093
10,455,879 B2 * 10/2019 Guice ..... A42B 1/206
10,537,145 B2 * 1/2020 Borrás Esteve ..... A42B 1/12
10,881,159 B2 * 1/2021 Geisinsky ..... A41G 3/0016
2006/0191057 A1 * 8/2006 Lynn ..... A42B 1/225 2/171
2007/0113319 A1 * 5/2007 Brinn ..... A42B 1/004 2/174
2007/0283975 A1 * 12/2007 Ma ..... A41G 5/0093 132/53
2008/0134405 A1 * 6/2008 Smith ..... A42B 1/12 132/54
2009/0139004 A1 * 6/2009 Vail ..... A41G 5/0093 132/53
2009/0241973 A1 * 10/2009 Hampton ..... A41G 3/0025 132/54
2010/0326455 A1 * 12/2010 Karsenti ..... A41G 3/0008 132/53
2011/0055996 A1 * 3/2011 Pomell ..... A42B 1/008 2/209.13
2015/0000002 A1 * 1/2015 Brown ..... A42B 1/12 2/68
2015/0059055 A1 * 3/2015 Johnson ..... A42B 3/10 2/181.4
2015/0190315 A1 * 7/2015 Montano ..... A61K 8/496 604/289
2015/0327614 A1 * 11/2015 Garden, Sr. ..... A42B 1/0182 2/209.12
2015/0335086 A1 * 11/2015 Murphy ..... A42B 1/041 2/171
2016/0106171 A1 * 4/2016 Ononibaku ..... A42B 1/12 2/68
2016/0157540 A1 * 6/2016 Dowdy ..... A42B 1/24 2/209.13
2018/0146734 A1 * 5/2018 Kelly ..... A42B 1/004
2021/0392984 A1 * 12/2021 Harris ..... A41G 3/0033
2022/0125147 A1 * 4/2022 Thomson ..... A42B 1/12

* cited by examiner

HEAD COVERING

FIELD OF THE INVENTION

The present invention relates generally to head coverings, more specifically but not by way of limitation, a head covering configured to keep the hair of a user thereof dry while in a pool or body of water or wet conditions, wherein the head covering of the present invention further includes a plurality of outer portions that are embodied as wigs of any style and length, hat or any style of headwear or a combination thereof.

BACKGROUND

Millions of people regularly patronize salons and similar businesses to purchase various products offered therefrom. Both men and women will spend thousands of dollars per year getting treatments on their hair such as but not limited to hair coloring, bleaching, extensions and perms. These procedures cost a great deal of money and can be sensitive to certain environments or conditions that will result in damage to the hair and result in the partial or complete loss of the treatment that the user paid for to have performed on their hair. By way of example but not limitation, if a user has their hair colored, getting the hair wet in a pool that is chlorinated can have a negative impact on the colored hair. Additionally, other hair product services can be damaged by salt water from the ocean or chlorinated water in a pool.

Utilization of a conventional swim cap has conventionally been deployed in an attempt to keep the hair dry and protect the hair from potential damage. These caps are quite aesthetically displeasing and the use thereof has diminished over the last several decades. For an individual who would like to engage in an activity where their hair can could get wet, many choose to not participate instead of wearing the conventional swim cap. Furthermore, conventional swim caps typically have a seal that does not provide effective waterproofing and many times water will leak into the cap proximate the bottom edge.

Accordingly, there is a need for a head covering that will protect a user's hair from wet environments that includes a first portion configured to be sealably coupled to the head of the user and a second portion wherein the second portion is releasably secured to the first portion and is provided in alternate aesthetic embodiments.

SUMMARY OF THE INVENTION

It is the object of the present invention to provide a head covering that is configured to protect a user's hair from getting wet to avoid potential damage thereto wherein the present invention includes a first portion and a second portion.

Another object of the present invention is to provide a device configured to inhibit exposure of the user's hair to water and further provide a plurality of aesthetic options wherein the first portion of the present invention is manufactured from elastic or similar waterproof material and is dome shaped.

A further object of the present invention is to provide a head covering that is configured to protect a user's hair from getting wet to avoid potential damage thereto wherein the first portion includes a cavity configured to receive a user's head therein.

Still another object of the present invention is to provide a device configured to inhibit exposure of the user's hair to water and further provide a plurality of aesthetic options wherein the first portion includes an outer surface wherein the outer surface has secured thereto a band member.

An additional object of the present invention is to provide a head covering that is configured to protect a user's hair from getting wet to avoid potential damage thereto wherein the band member includes a plurality of fasteners thereon.

Yet a further object of the present invention is to provide a device configured to inhibit exposure of the user's hair to water and further provide a plurality of aesthetic options wherein the second portion is releasably secured to the first portion.

Another object of the present invention is to provide a head covering that is configured to protect a user's hair from getting wet to avoid potential damage thereto wherein the second portion is provided in a plurality of alternate aesthetic embodiments.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
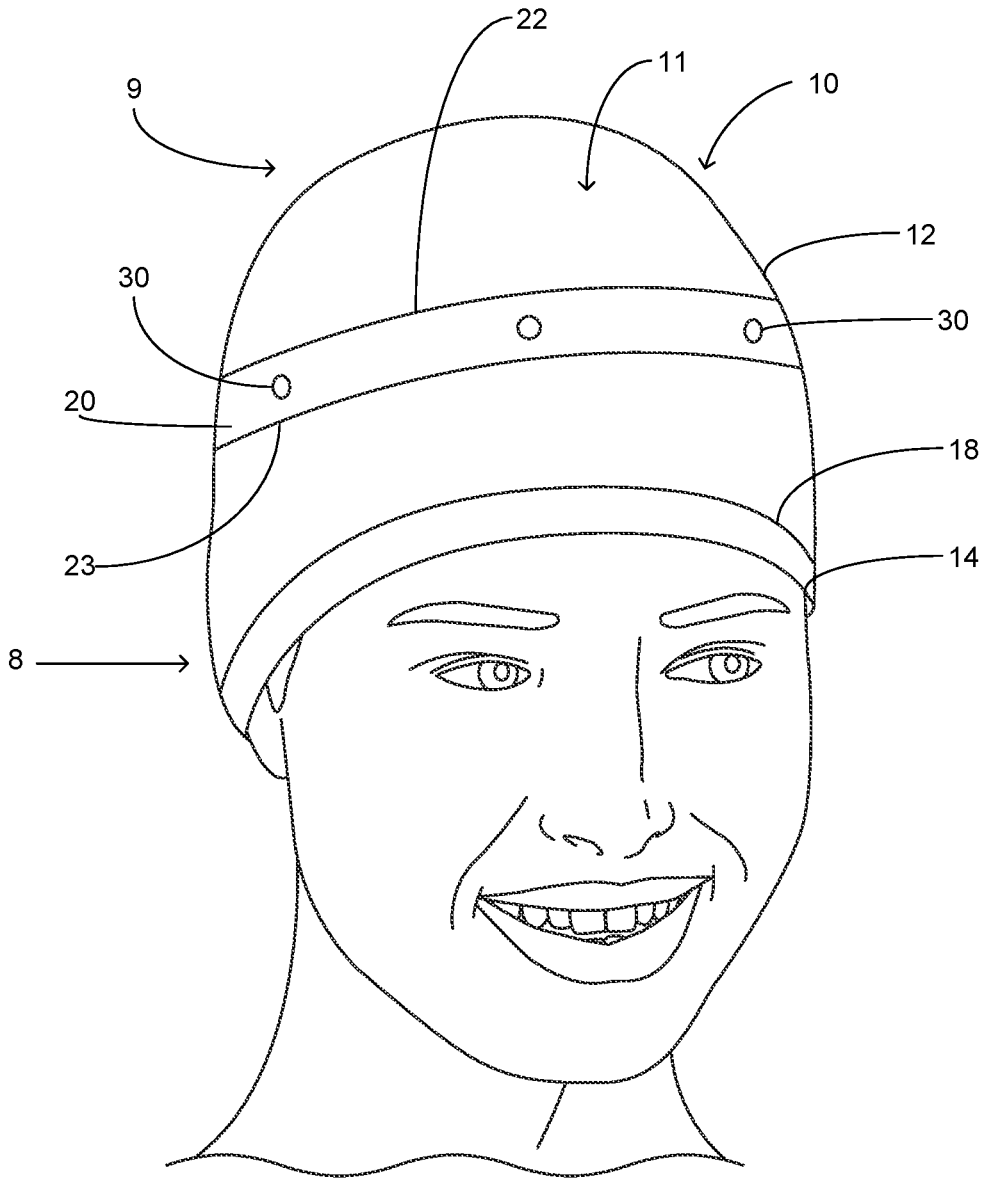
FIG. 1 is a perspective view of the first portion of the present invention.

Referring now to the drawings submitted herewith, wherein various elements depicted therein are not necessarily drawn to scale and wherein through the views and figures like elements are referenced with identical reference numerals, there is illustrated a head covering 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof, the head covering 100 includes a first portion 10 and a second portion 50. The first portion 10 and second portion 50 are configured to be releasably secured. The second portion 50 is illustrated herein two alternative embodiments but it should be understood within the scope of the present invention that the second portion 50 is configured to provided in a plurality of sizes and alternative embodiments in order to provide various aesthetic appearance based on the user's preference.

Referring in particular to FIG. 1 submitted as a part hereof, the head covering 100 includes a first portion 10. The first portion 10 includes a wall membrane 12 wherein the first portion 10 is generally dome shaped so as to be superposed a user's head. The first portion 10 is manufactured from a durable waterproof material such as but not limited to silicon or Goretex. The first portion 10 includes a cavity (not particularly illustrated herein) that is configured to receive a user's head therein. The first portion 10 function to inhibit moisture and/or water from penetrating therethrough to the user's hair. The first portion 10 includes a first seam 14 wherein the first seam 14 is along the lower peripheral edge of the first portion 10. In a preferred embodiment the first seam 14 is constructed so as to have an elasticity slighter greater than that of the wall membrane 12 so as to ensure maintenance thereof proximate the head of the user during use of the head covering 100. The aforementioned property of the first seam 14 creates a seal at the lower perimeter edge of the first portion 10 so as to inhibit water from egressing therepast.

The first portion 10 further includes a second seam 18. The second seam 18 is adjacent to and parallel with the first seam 14 around the entire lower perimeter of the first portion 10. In a preferred embodiment of the present invention the second seam 18 is a superabsorbent polymer wherein the second seam 18 is secured to an inner surface of the wall membrane 12 such that the second seam 18 is intermediate the inner surface of the wall membrane 12 and the head of the user. The second seam 18 is present to ensure capture of any liquid that egresses past the first seam 14. It should be understood within the scope of the present invention that the second seam 18 could be provided in alternate thicknesses, widths and be manufactured from various absorbent materials in order to achieve the objective as discussed herein.

Secured to the outer surface 11 of the first portion 10 is band member 20. Band member 20 is secured to the outer surface 11 of the first portion 10 utilizing suitable techniques such as but not limited to chemical adhesion or mechanical fastening. The band member 20 is manufactured from a durable water proof material such as but not limited to silicon. Band member 20 is circumferentially secured to the outer surface 11 of the first portion 10 approximately at a midpoint between the upper end 9 and lower end 8. It should be understood within the scope of the present invention that the band member 20 could be provided in alternate heights based upon a particular need from the second portion 50. The band member 20 includes an upper edge 22 and a lower edge 23 that define the height thereof. The band member 20 has a plurality of fasteners 30 secured thereto. The fasteners 30 are configured to releasably couple to fasteners present on an inner surface of the second portion 50 as is further discussed herein. It should be understood within the scope of the present invention that the fasteners 30 could be a plurality of alternate types of mechanical fasteners such as but not limited to snaps or hook and loop. It should be further understood within the scope of the present invention that the fasteners 30 could be distributed on the band member 20 in various patterns and include alternate quantities thereof. Additionally, it should be understood within the scope of the present invention that the fasteners 30 could be secured directly to the outer surface 11 of the wall membrane 12 as an alternative to placing the fasteners 30 on the band member 20. While the band member 20 and fastener 30 combination is employed so as to offer greater structural integrity for larger second portions 50, it is contemplated within the scope of the present invention that the fasteners 30 could be secured to the wall membrane 12 in various locations and patterns in order to facilitate releasable securing of the second portion 50.

Figure 2:
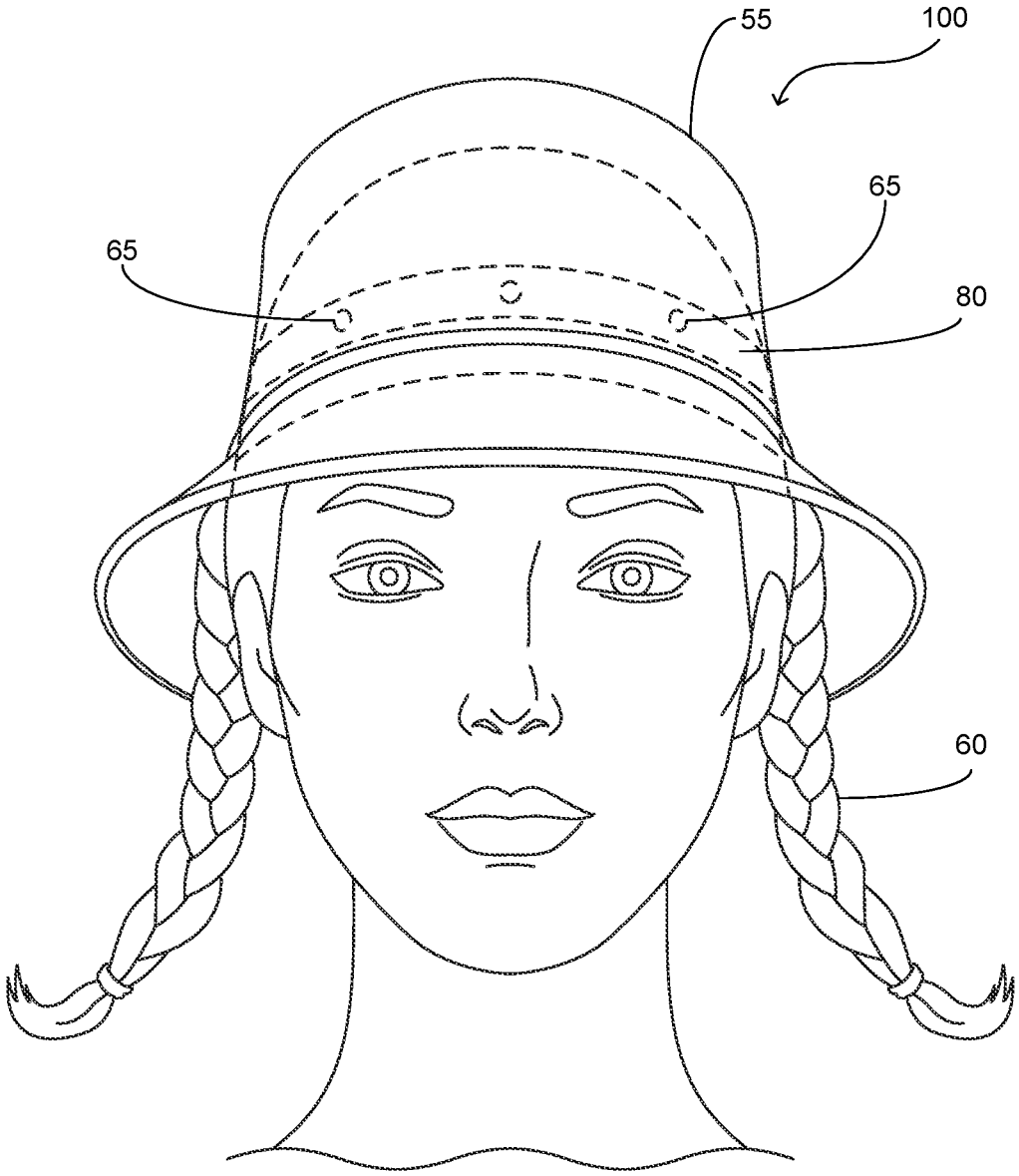
FIG. 2 is a perspective view of the present invention with an exemplary second portion secured to the first portion.
Figure 3:
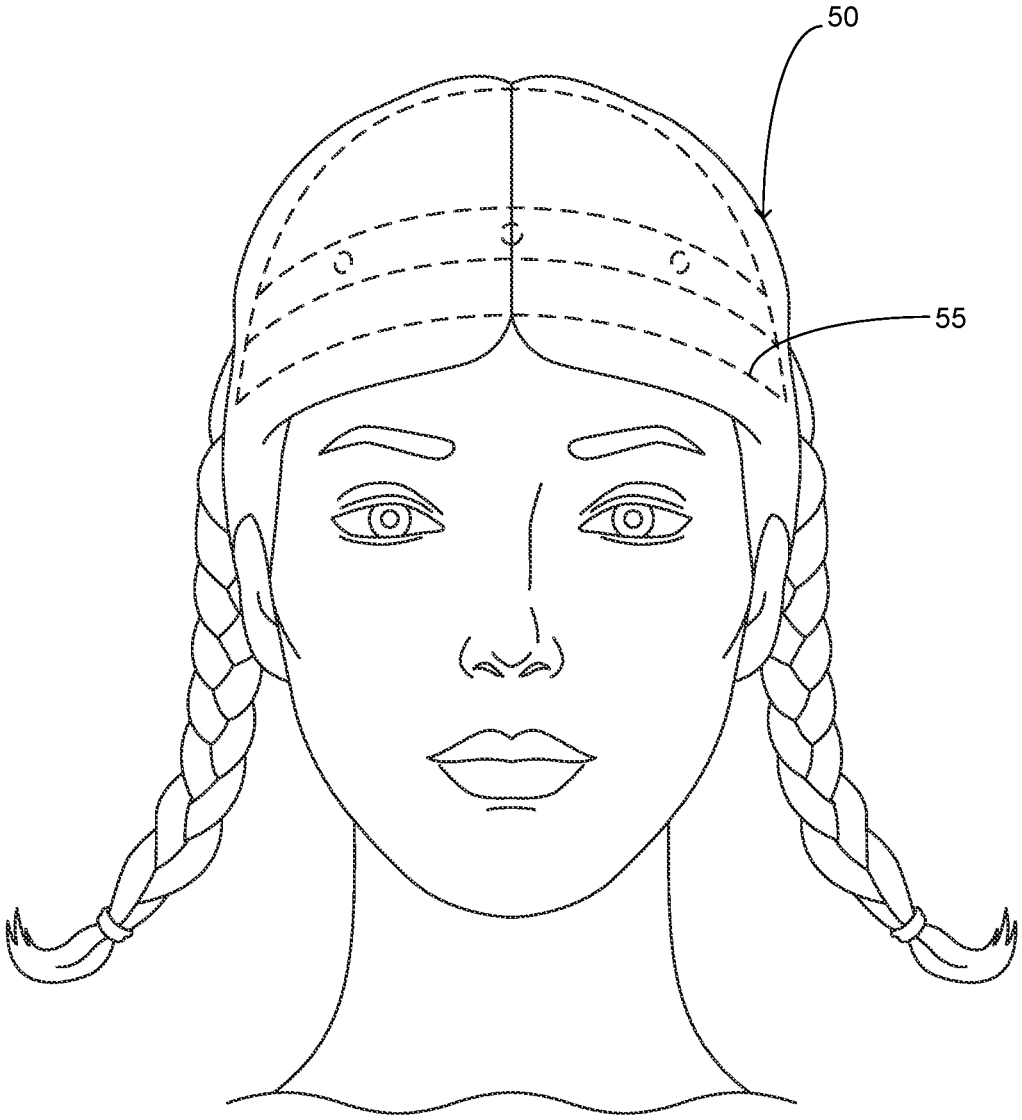
FIG. 3 is a perspective view of the present invention with an alternate exemplary second portion secured to the first portion

Submitted herewith in FIGS. 2 and 3, are exemplary embodiments of the second portion 50 of the head covering 100. The second portion 50 is provided to offer a plurality of alternate aesthetic embodiments to change the outward appearance of the head covering 100. The second portion 50 includes a first section 55 and a second section 60 as is illustrated herein in FIG. 2. In the embodiment illustrated herein in FIG. 2, the first section 55 is embodied as a hat while the second section 60 is embodied as hair. The first section 55 and second section 60 are operably coupled utilizing suitable techniques so as to provide a single second portion 50 for the user to secure to the first portion 10. The second portion 50 includes fasteners 65 that are aligned with fasteners 30 and are operable to mateably couple therewith. The fasteners 65 are secured to a second band member 80 that is secured to the inner surface of the second portion 50 utilizing suitable techniques. The fasteners 65 and second band member 80 are configured to align with band member 20 and fasteners 30. As previously discussed with the first portion 10, it is contemplated within the scope of the present invention that the second portion 50 could be provided with no band member 80 and have the fasteners 65 secured to the inner surface thereof wherein the fasteners 65 would be in alignment with fasteners 30 subsequent the second portion 50 being superposed the first portion 10. It should be understood within the scope of the present invention that the first section 55 illustrated herein if FIG. 2 along with the second section 60 could be any combination of hat and hairstyle respectively.

FIG. 3 illustrates an alternate embodiment of the second portion 50 having only the first section 55 wherein the first section 55 is an exemplary wig. It should be understood that the exemplary first section 55 illustrated in FIG. 3 herein could be provided in a multitude of hairstyles and is secured identically as described herein for first section 55 referencing FIG. 2 submitted herewith.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A head covering operable to inhibit a user's hair from being contacted by water wherein the head covering comprises:

a first portion, said first portion having a wall membrane and being dome shaped, said first portion having a lower end and an upper end, said first portion having a cavity configured to receive a portion of a user's head therein, said first portion having an elastic material circumferentially surrounding the lower end of the first portion, the elastic material having a first seam, said first seam being proximate a lower peripheral edge of said first portion and the elastic material having a second seam, said second seam being adjacent said first seam, said second seam being more proximate said upper end of said first portion;

a second portion, said second portion configured to be superposed said first portion, said second portion being releasably secured to said first portion, said second portion configured to provide an alternative aesthetic embodiment to the first portion, said first portion further includes a band member secured to an outer surface of the wall membrane, said band member being circumferentially disposed around said wall membrane, said band member being positioned at a midpoint between said lower end and said upper end of the first portion and said band member operative to releasably secure said second portion.

2. The head covering operable to inhibit the user's hair from being contacted by water as recited in claim 1, wherein said band member includes a plurality of fasteners secured thereto.

3. The head covering operable to inhibit the user's hair from being contacted by water as recited in claim 2, wherein said second portion is embodied as a wig.

4. The head covering operable to inhibit the user's hair from being contacted by water as recited in claim 2, wherein said second portion is embodied as headwear.

5. The head covering operable to inhibit the user's hair from being contacted by water as recited in claim 2, wherein said second portion is embodied as a wig of any style and length, headwear of any style or a combination thereof.

6. The head covering operable to inhibit the user's hair from being contacted by water as recited in claim 1, wherein said second portion extends beyond the lower peripheral edge of the first portion.

* * * * *